United States Patent [19]

Gämmerler

[11] Patent Number: 4,900,007

[45] Date of Patent: Feb. 13, 1990

[54] DEVICE FOR CHANGING THE DIRECTION OF A PRODUCT FLOW, PARTICULARLY OF PAPER PRODUCTS SUPPLIED IN SHINGLED FORMATION

[76] Inventor: Gunter Gämmerler, Sudetenstrasse 31, D-8190 Wolfratshausen, Fed. Rep. of Germany

[21] Appl. No.: 252,853

[22] Filed: Oct. 3, 1988

[30] Foreign Application Priority Data

Oct. 7, 1987 [DE] Fed. Rep. of Germany ..... 3733906

[51] Int. Cl.[4] ..... B65H 29/60

[52] U.S. Cl. ..... 271/185; 271/225; 271/272; 198/457; 198/861.2

[58] Field of Search ..... 271/31, 184, 185, 225, 271/272, 302, 303; 198/369, 436, 457, 627, 861.2

[56] References Cited

U.S. PATENT DOCUMENTS

| | | | |
|---|---|---|---|
| 2,216,546 | 10/1940 | Cartlidge | 198/861.2 |
| 2,593,242 | 4/1952 | Bacon et al. . | |
| 2,725,972 | 12/1955 | Howdle . | |
| 3,856,132 | 12/1974 | Sakurai et al. | 271/34 |
| 4,424,966 | 1/1984 | Chandhoke | 271/302 |
| 4,670,081 | 6/1987 | Takahashi et al. | 198/627 |

FOREIGN PATENT DOCUMENTS

| | | | |
|---|---|---|---|
| 18057 | 10/1980 | European Pat. Off. | 271/34 |
| 2721138 | 1/1978 | Fed. Rep. of Germany . | |
| 2636363 | 9/1978 | Fed. Rep. of Germany . | |
| 2224981 | 1/1979 | Fed. Rep. of Germany . | |
| 2823247 | 11/1979 | Fed. Rep. of Germany | 271/184 |
| 2637701 | 3/1982 | Fed. Rep. of Germany . | |

*Primary Examiner*—F. J. Bartuska
*Assistant Examiner*—Steve Reiss
*Attorney, Agent, or Firm*—Paul L. Sjoquist

[57] ABSTRACT

A device for changing the direction of flow of paper products supplied in shingled formation with an inflow element, and an outflow element, wherein the inflow element incorporates suitable guide rollers for guiding pressure belts handling the product flow, and the outflow element incorporates further guide rollers mounted on carriers which may be swiveled, for the purpose of changing the direction of the product flow between 0° and 45°.

7 Claims, 2 Drawing Sheets

Figure 1:
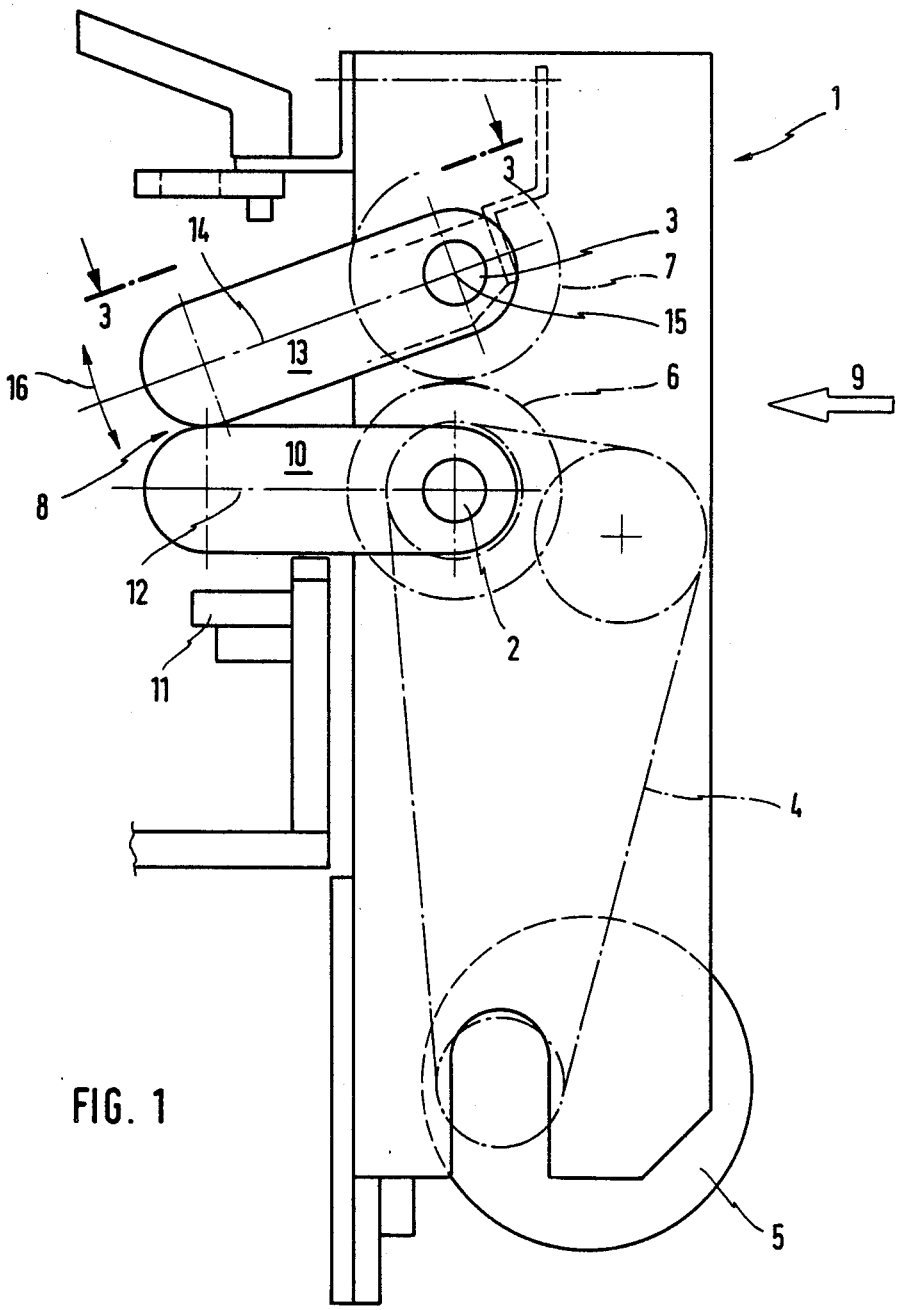

DEVICE FOR CHANGING THE DIRECTION OF A PRODUCT FLOW, PARTICULARLY OF PAPER PRODUCTS SUPPLIED IN SHINGLED FORMATION

This invention relates to a device for changing the direction of a product flow, particularly of paper products supplied in shingled formation having an inflow element, an accumulating plate and an outflow element.

Handling paper products, particularly when these are conveyed multi-layer in shingled formation, often necessitates changing the direction of the product flow in the horizontal plane by a certain angle which is usually 90° . This is true especially when the paper products are required to be cut or trimmed on three sides. For changing the direction of flow in this way, devices are used which usually feature a horizontal plate, an accumulator plate located vertical to the latter and provided adjustable on the horizontal plates and which may be provided with a diverter roll. Changing the direction of the product flow by 90° is done on the table or on the mounting plate. To facilitate the change in the direction of flow and especially to prevent any change in the formation of the products it is prior art to provide for a change in the direction of the product flow first by 45° immediately following the inflow before providing the further change in the direction of flow by a further 45° . In this prior art device, however, it is not possible to adjust the angle of the change of direction.

The object of the present invention is to change the direction of the product flow having an inflow of differing angular positions — according to requirements.

This object is achieved by the invention providing for suitable guidance of the pressure belts, or the like, handling the product flow by achieving an angular change in the direction of the product flow between 0 and 45° in the inflow. Pressure belts in the sense of the present invention are also understood to include straps, rubber bands of suitable thickness or also profiled rubber bands; link chains which may have a rubber surface to take the product flow also being understood to be included.

The inflow may feature at least two pairs of pressure belts, or the like, acting in combination, the conveyor device of which is adjustable between 0 and 45°.

In one preferred embodiment of the invention each pair of pressure belts, or the like, features a guide roller, a guide roll, or the like, the axis of which runs perpendicular to the direction of inflow — preferably in the horizontal plane — and which has at least one guide roller having an axis which can be swivelled preferably in the horizontal plane. Said swivelling axis may be provided on a carrier, or the like, featuring at least one diverter sheave, or the like, with one axis perpendicular to the axes of the guide rollers, whereby the pressure belt, or the like, may have a round or near-round cross-section. Said diverter sheaves, or the like, are sensibly arranged in pairs.

Preferably the mounts and carriers of the one endless pressure belt, or the like, with respect to the mounts and carriers of the corresponding pressure belt, or the like, form a flaring acute angle to the supply conveyor. Preferentially is/are at least one pressure belt pair(s) or the like, height-adjustable with respect to the neighboring pair(s) of pressure belts. Providing for height-adjustment of a pair of pressure belts, or the like, not located at the edge of the product flow results in the formation receiving a slight swelling in the middle area which stiffens the paper product or the complete formation on inflow into the device for changing the direction of the product flow. It is, of course, immaterial whether said swelling is directed upwards or downwards.

The mounts of the lower pressure belts, or the like, and those of the upper pressure belts, or the like, are sensibly each mounted on a shaft and each carry a guide roller, guide roll, or the like, which may be driven; both shafts can be made to run in synchronism by gear-wheels, or the like, provided at one end of said shafts and wherein one shaft may be driven at the other end only.

In one preferred embodiment of the invention the carriers, or the like, may form an acute merging angle in the outflow direction in the horizontal plane and may carry each a guide roller, or the like. Opening the pair of pressure belts in the direction of the supply conveyor simplifies the design in that handling of the product flow does not commence until it is a distance away from the front guide rollers, i.e. following the change in the direction of flow of the pressure belts to achieve the desired angular position.

The carriers, or the like, may mount at least one each diverter sheave, diverter roll, or the like, at the extremity of the inflow end at least at a distance away from their top and bottom surfaces running perpendicular to the axis of the guide roller, guide roll, or the like. Particular preference is given to an embodiment in which the mount, or the like, and/or the carrier, or the like, is spring-mounted for swivelling about its axis, said carrier being preferably the upper carrier of each pair of pressure belts. This arrangement makes it possible to achieve, on the one hand, spring- mounting of the upper mount and carrier and , on the other hand, adaptation to differing thicknesses of the product flow.

The mounts of each pressure belt, or the like, are preferably provided for shifting on their shafts and can be locked to a rod, or the like, running parallel to said shafts. The diverter sheaves, diverter rolls, or the like, located above and below the carriers each feature preferably a common shaft running more or less vertically, or the like. It is also possible that the two shafts, or the like, are held in a vertical frame, or the like, which may be sharp-cornered and which is mounted removable at the inflow end of the device for changing the direction of a product flow.

Whilst angular adjustment can be made continuously between the angles 0 and 45° without further ado, wedges, or the like, of differing sizes are provided for incrementally adjusting the angle of the carriers, or the like. One axis of the diverter sheave, or the like, of a carrier, or the like, may also form the swivelling axis of the latter.

Figure 2:
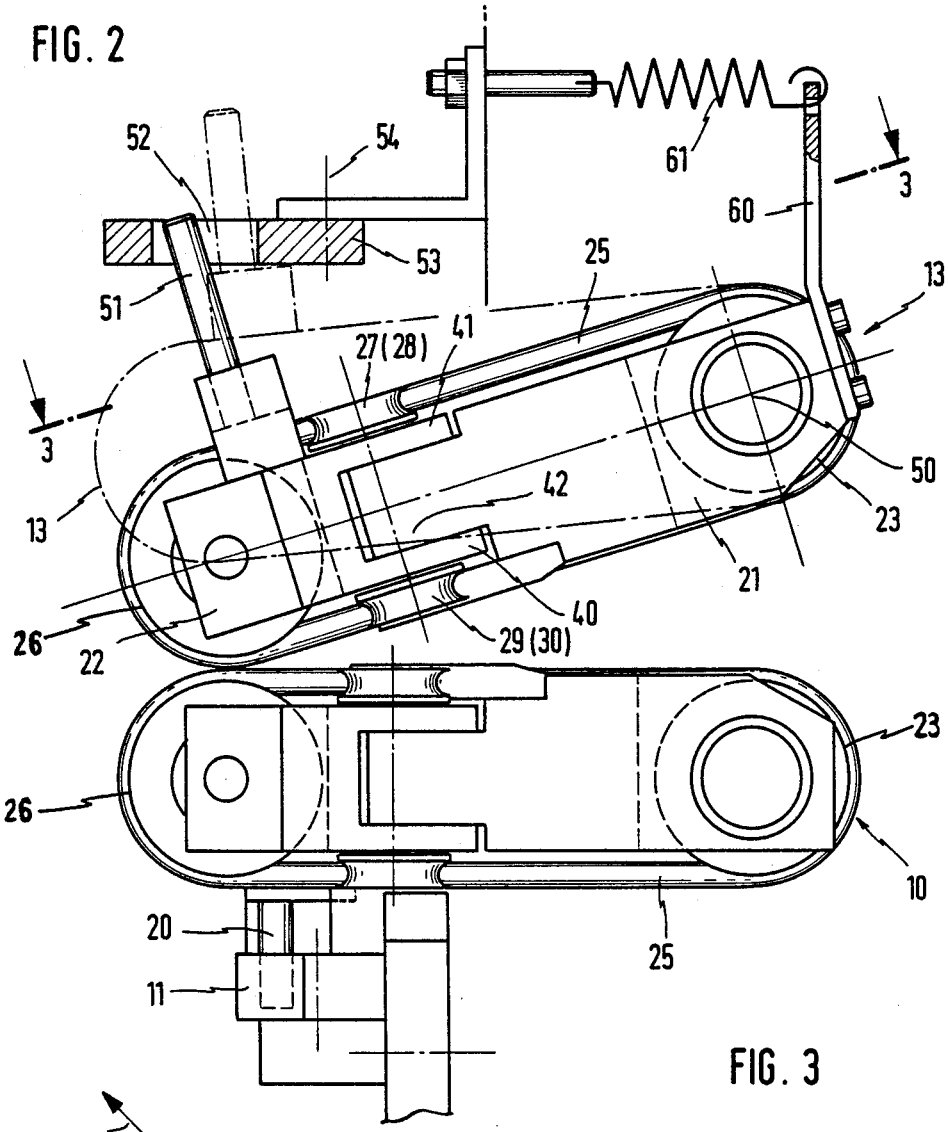
Figure 3:
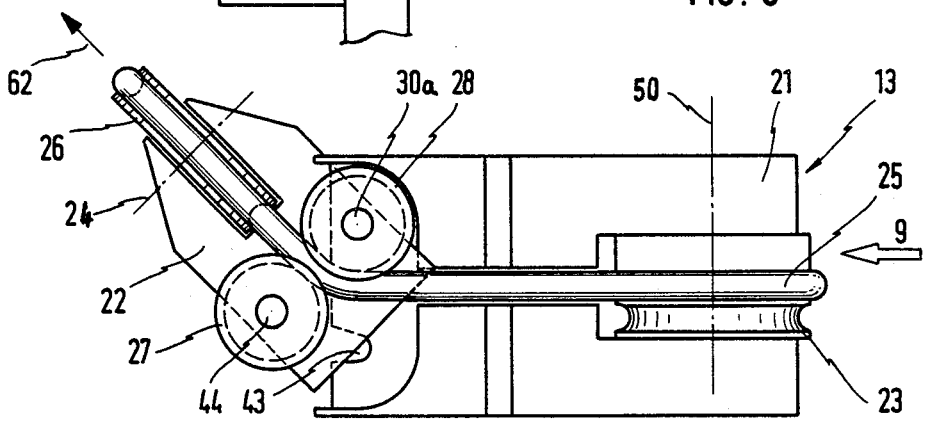

One embodiment of the invention, by way of example, will now be described and with reference to the accompanying drawing in which:

FIG. 1 is a cross-sectional elevation through one embodiment of the invention, FIG. 2 is a cross-sectional elevation through one part of said embodiment on an enlargened scale and FIG. 3 is a plan view of a part of the device taken along line 3—3 of FIG. 1 and FIG. 2.

A rectangular frame 1 extending perpendicular to the plane of the drawing and one short side of which is shown, carries two shafts 2 and 3, which are driven in synchronism by means of an electric motor 5 via an endless belt 4. Said two shafts 2 and 3 are driven in synchronism via gearwheels 6 and 7 provided at one end of said shafts. Each shaft 2 and 3 mounts pairs of elements 8. At least two such pairs of elements must be provided; in conventional rotary cutting systems having an over-corner change of direction provided on the frame 1 in the inflow at least three, possibly four to five pairs of elements 8 are provided. The direction of the product flow from the feeder conveyor is indicated by the arrow 9.

Each pair of elements comprises two essentially identical elements, of which the lower element 10 is locked to a rail 11 extended over the width of the frame and running vertical to the plane of the drawing. The longitudinal axis 12 of the lower element 10 runs horizontal. Each of the lower elements is secured equally spaced to the rail 11.

The upper element 13 is located by its longitudinal axis 14 in an acute angle to the longitudinal axis 12 of the lower element; it is — as detailed in the following — spring-mounted and height-adjustable. In addition each element 13 can be swivelled also about the fulcrum 15 in the direction of the arrow 16.

As can be seen from FIG. 2, the lower element 10 can be locked to the rod 11 by means of screw-type pins 20.

Each element 10 or 13 features a block-type mount 21 and a carrier 22. Said block-type mount provides a bifurcated hold of a guide roller 23, the axis 50 of which runs perpendicular to the product flow. Said guide roller 23 is provided with two semi-circular ring grooves for locating a pressure belt 25 having a round cross-section. Said pressure belt 25 is an endless belt which is supported at the outflow end by a guide roller 26, the axis 24 of which runs perpendicular to the product flow but which can also be swivelled in the horizontal plane between 0 and 45°. In the plan view of element 13 in FIG. 3 the carrier 22 and the guide roller 26 is set at an angle of 45° to the inflow direction of the product flow.

The endless belt 25 running above and below the mount 21 and around the carrier 22 is guided by two diverter sheaves 27 and 28 at the upper end of carrier 22 and by a suitable pair of diverter sheaves 29 and 30 at the lower end of carrier 22. In angular adjustment of carrier 22 about the axis 30*a* which is simultaneously the turning axis of diverter sheave 28 and of the corresponding diverter sheave 30 at the lower end of the carrier, the run of the endless belt 25 is as shown at the upper end of mount 21 and of carrier 22 and at the lower end accordingly.

The diverter sheaves 27 and 28 respectively and the corresponding diverter sheaves 29 and 30 provided at the lower end of carrier 22 are formed in such a way that the respective ring grooves are respectively offset outwards with respect to the center plane of the corresponding diverter sheaves, thus resulting in the outer edge of the endless belt 25 projecting over the free edge of the corresponding diverter sheave 27 -30.

As can be seen in particular from FIG. 2 the two arms 40, 41 of the carrier 22 clasp a corresponding projection 42 of mount 22. Whilst the shaft (not shown) of axis 30*a* is mounted in said projection 42, the corresponding projection ( see FIG. 3) has a recess 43 in which the thru-shaft of axis 44 is accommodated when carrier 22 is swivelled in place.

Whilst the lower element 10 is located fixed, the upper element 13 can be swivelled upwards about its axis 50, a pin 51 at the upper end of carrier 22 then locating a longitudinal slot 52 running parallel to the plane of the drawing. This longitudinal slot ensures that the carrier 22 of element 13 is unable to slip away sideways. At the other end the flange 53 featuring the longitudinal slot 52 can be swivelled about the axis 54, thus permitting the position of carrier 22 of element 13 to be achieved as shown in FIG. 3 as a plan view. In addition, the longitudinal slot 52 permits element 13 to be swivelled up about axis 50, however, the pin 51 extending into the longitudinal slot then being able to be moved to and fro between the two positions as shown.

Mount 21 of the upper element 13 is also connected via a flange 60 to a spring 61 so that element 13 also has a certain degree of spring movement about the axis 50. Locking the carrier 22 in any angular position between 0° and 45° can be achieved by any means; however, it is also possible to provide for incremental locking of this carrier in an angular position between 0 and 45° by means of wedges. Changing the direction of the product flow from the direction of the arrow 9 into the direction of the arrow 62, for example, is achieved in that the product flow from the supply conveyor is pushed into the open gap between the two guide rollers 23 with their endless belts 25 and in that, as a result of the narrowing gap, the product flow, as shown in FIG. 2, is not guided and suitably changed in direction until it reaches the area of the guide rollers 26.

Instead of the pressure belts having a round cross-section as shown and described, belts can also be used edgewise, for example; it is also possible to use link chains instead of the endless belts 25; said link chains would then have to be provided on the outside with suitable rubber sections or flexible plastic sections.

What is claimed is:

1. A device for changing the direction of a product flow, particularly of paper products supplied in shingled formation comprising:

an inflow element having at least two pairs of spaced-apart pressure belts guided about respective guide rollers aligned in a first conveying direction, the respective axes of said guide rollers being perpendicular to said first conveying direction;

an outflow element having further guide rollers respectively mounted on upper and lower carriers, the carriers connected to the inflow element by respective swivel axes, including means for swiveling said carriers about said swivel axes to align said further guide rollers along a second conveying direction; at least a pair of diverter sheaves mounted to said carriers about said respective swivel axes;

wherein each said respective pressure belt is guided about a guide roller in said inflow element, at least one of said diverter sheaves, and one of said further guide rollers whereby to direct said pressure belt from said first conveying direction to said second conveying direction.

2. The device of claim 1, wherein said means for swiveling said carriers further comprises means for fixing said second conveying direction at an angle of 0° to 45° relative to said first conveying direction.

3. The device of claim 2, wherein said pressure belt is substantially round in cross section.

4. The device of claim 3, wherein each of said diverter sheaves further comprise a pair of spaced-apart rollers positioned to guide said pressure belt therebetween.

5. The device of claim 2, further comprising a vertical frame means for supporting said inflow element and said outflow element, said vertical frame means for supporting providing an acute angle between respective inflow and outflow elements.

6. The device of claim 5, further comprising a drive means connected to said frame, including means for synchronously driving said inflow element guide rollers.

7. The device of claim 2, wherein said upper and lower carriers are positioned to guide respective upper and lower guide belts about said further guide rollers into contacting position.

* * * * *